United States Patent [19]

Nicholson

[11] 4,295,506

[45] Oct. 20, 1981

[54] WEDGE

[75] Inventor: William H. Nicholson, Sutton, Mass.

[73] Assignee: Norman S. Blodgett, Worcester, Mass.

[21] Appl. No.: 97,450

[22] Filed: Nov. 26, 1979

Related U.S. Application Data

[63] Continuation of Ser. No. 947,258, Sep. 29, 1978, abandoned.

[51] Int. Cl.[3] ..... B27L 7/00

[52] U.S. Cl. ..... 144/193 D

[58] Field of Search ..... 254/104; 144/193 D, 144/193 E

[56] References Cited

U.S. PATENT DOCUMENTS

| | | | |
|---|---|---|---|
| 1,209,262 | 12/1916 | Church | 254/104 |
| 1,319,656 | 10/1919 | Merwin | 254/104 |
| 1,380,559 | 6/1921 | Jespersen | 254/104 |
| 2,212,080 | 8/1940 | Seward | 254/104 |
| 3,377,052 | 4/1968 | Hagen | 254/104 |
| 3,515,372 | 6/1970 | Courville | 254/104 |
| 4,194,544 | 3/1980 | Scott et al. | 144/193D |

FOREIGN PATENT DOCUMENTS

| | | | |
|---|---|---|---|
| 136245 | 1/1934 | Austria | 144/193 E |

*Primary Examiner*—Robert C. Watson

*Attorney, Agent, or Firm*—Norman S. Blodgett; Gerry A. Blodgett

[57] ABSTRACT

A wedge having two opposite faces lying at an acute angle to define a cutting edge and having a point that extends beyond the edge to assist in introducing the wedge into the grain of a log.

10 Claims, 7 Drawing Figures

WEDGE

This is a continuation of application Ser. No. 947,258, filed Sept. 29, 1978, now abandoned.

BACKGROUND OF THE INVENTION

In splitting a log, it is common practice to introduce a conventional wedge into the grain of the log by driving it with a sledge hammer. In order to accomplish this effectively, it is necessary to use a hammer having a substantial weight, sometimes as much as 12 pounds. Before the hammer can be used effectively with a full stroke, however, it is necessary that the wedge be started, i.e., driven into the log far enough to be self-supporting, so that the man performing the operation can use both hands on the hammer. In order to "start" conventional wedges, therefore, it is necessary to hold the wedge in one hand, while tapping it with the sledge hammer in the other. This ia a difficult operation to perform, since the hammer (being as heavy as its is) is difficult to handle with one hand. An alternative method is to start the wedge by using a small sledge weighing about two pounds; then, once the wedge has been firmly imbedded, one switches to the heavier sledge hammer. This means changing the hammers, of course, which is troublesome and lends a complexity to the operation which is undesirable. In both of the old methods of starting the wedge, it is necessary to hold the log between one's knees while starting the wedge. The shape of the conventional wedge has always been a compromise between a narrow-angle edge which is necessary to start the wedge into the grain and a wide-angle edge which produces the best splitting action once the wedge is self-supporting. These and other difficulties experienced with the prior art devices have been obviated in a novel manner by the present invention.

It is, therefore, an outstanding object of the invention to provide a wedge having a self-starting feature for introducing it into the grain of the log.

Another object of this invention is the provision of a wedge which can be introduced into the log with one hand, after which it can be driven with a heavy sledge hammer.

A further object of the present invention is the provision of a wedge having a narrow angle portion for starting it in the log and a wide angle portion for optimum splitting action.

It is another object of the instant invention to provide a wedge which requires no auxiliary tool for starting, so that the only tool necessary besides the wedge is a large sledge hammer for the splitting action.

A still further object of the invention is the provision of a wedge having a point which permits it to be used in the manner of a dart or a spear to introduce it into the grain of the wood for self-support therein.

It is a further object of the invention to provide a wedge of integral construction which is simple in nature, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a wedge for splitting a wooden log, the wedge having a main body with two plane face surfaces lying at an acute angle to each other and terminating in a transverse edge. An integral point extends beyond the edge to assist in introducing the wedge into the grain of the log.

More specifically, the point has face surfaces which are extensions of the face surfaces of the main body and lie at the same acute angle to one another, while the edge is defined by two plane surfaces which lie at a substantially greater angle than the said acute angle.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
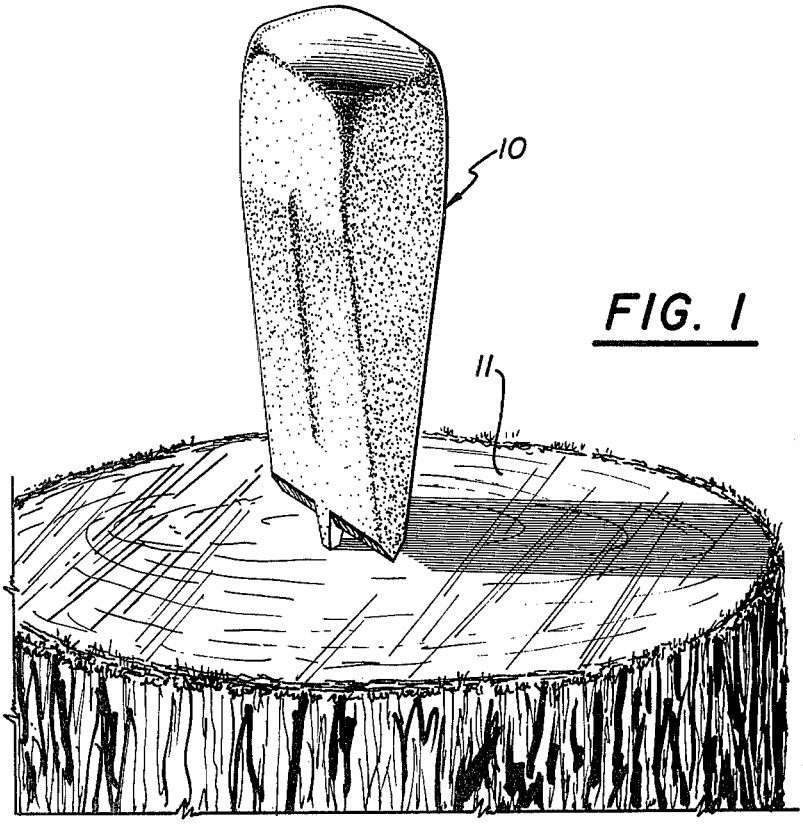
FIG. 1 is a perspective view of a wedge embodying the principles of the present invention shown in use with a log.

Referring first to FIG. 1, wherein are best shown the general features of the invention, the wedge, indicated generally by the reference numeral 10, is shown in use in splitting a wooden log 11. In the illustration the log is vertically positioned and the wedge is shown as entering the end grain.

Figure 2:
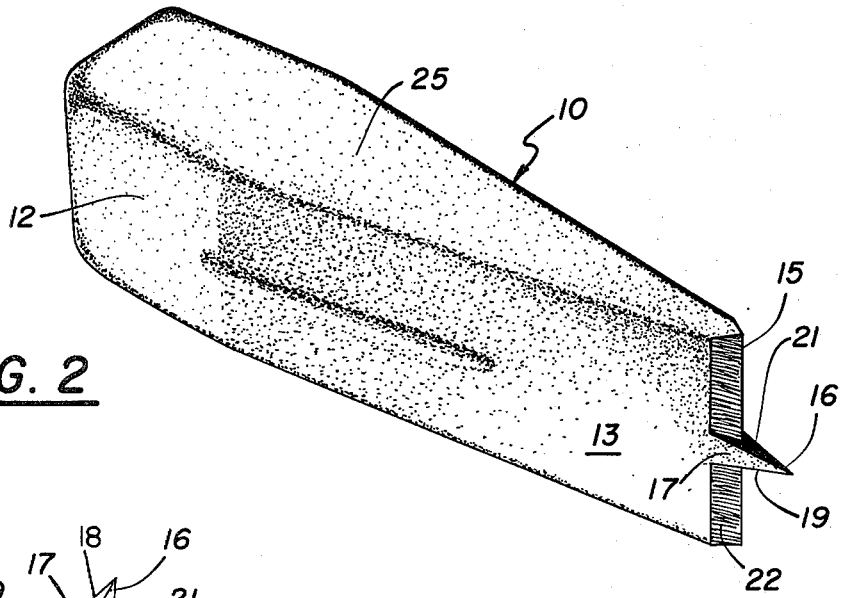
FIG. 2 is a somewhat enlarged perspective view of the wedge.
Figure 4:
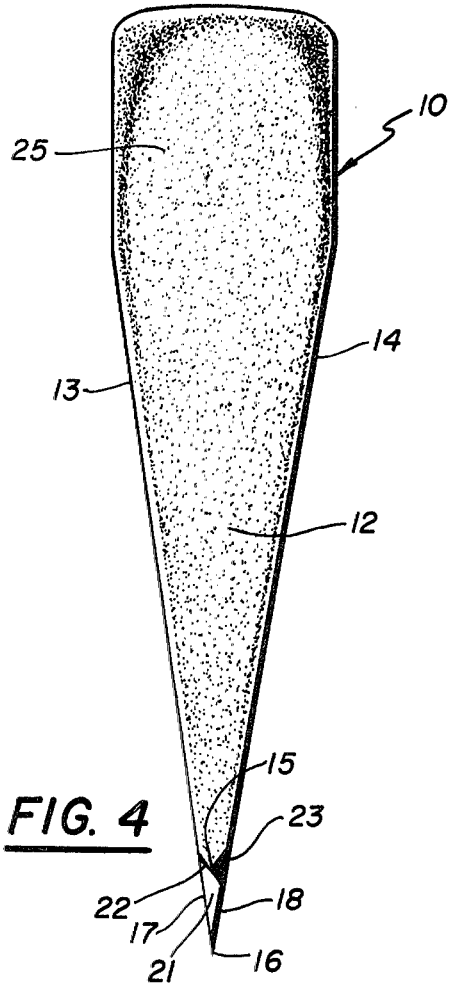
FIG. 4 is a side elevational view of the wedge.

FIG. 2 shows the general features of the wedge, including the fact that it consists of a main body 12, having two plane face surfaces 13 and 14 (see FIG. 4). The surfaces 13 and 14 lie at an acute angle to one another and terminate in a transverse edge 15. An integral point 16 extends beyond the edge 15 to assist in introducing the wedge into the grain of the log. In the preferred embodiment, the main body 12 and the point 16 are integrally forged of steel and suitably heat-treated.

Figure 3:
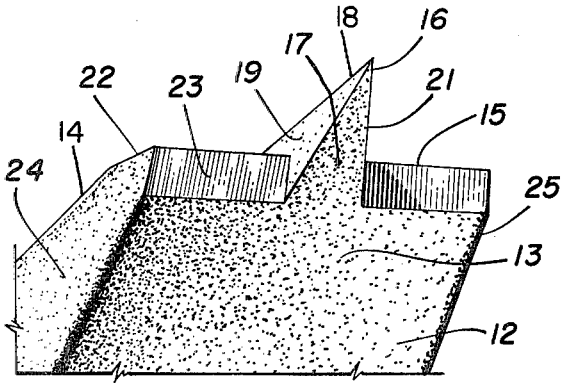
FIG. 3 is a perspective view of the operative end of the wedge.
Figure 5:
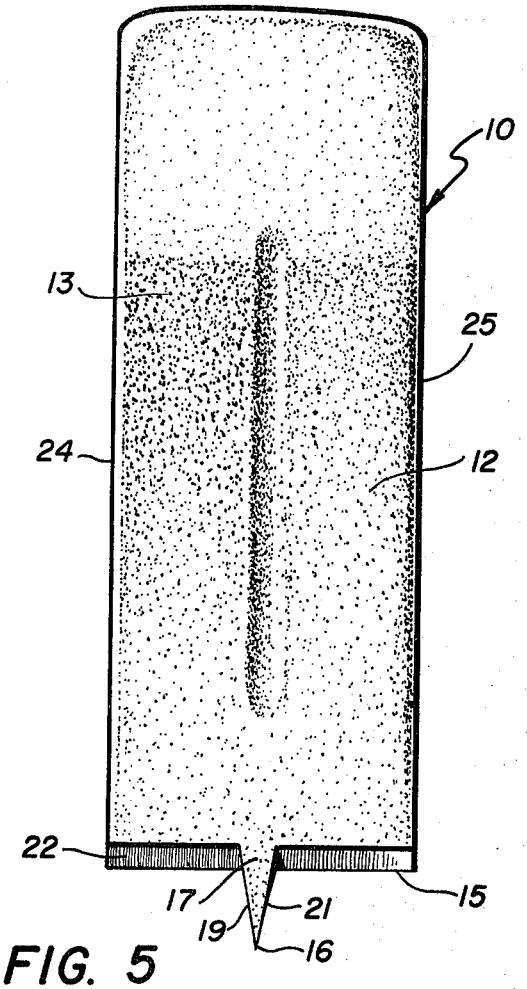
FIG. 5 is a front elevational view of the wedge.
Figure 6:
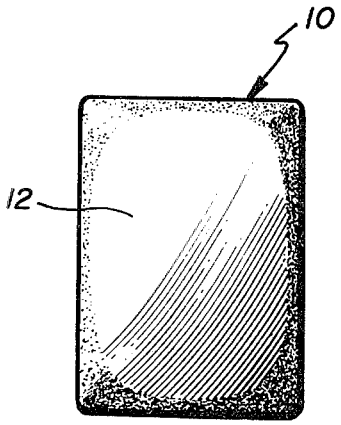
FIG. 6 is a top plan view of the wedge.
Figure 7:
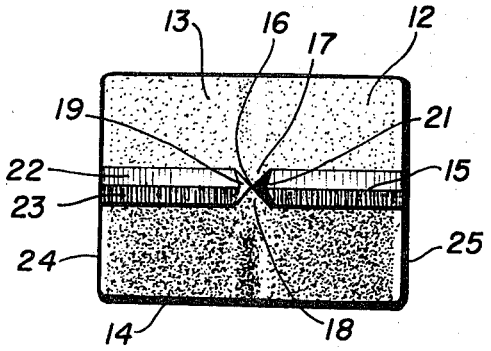
FIG. 7 is a bottom plane view of the wedge.

As is particularly evident in FIG. 3, the point 16 is bounded by two plane face surfaces 17 and 18, each of which lies in the plane of one of the surfaces 13 and 14, respectively, of the main body. The point is also defined by two plane side surfaces 19 and 21 which also lie at an acute angle to one another, as is best evident in FIG. 5.

Referring to FIGS. 2 through 7, which show various details of the invention, the transverse edge 15 is defined by two plane blade surfaces 22 and 23. These surfaces lie at an acute secondary angle to one another, which secondary angle is substantially greater than the angle between the face surfaces 13 and 14 of the main body. The main body is also provided with two plane side surfaces 24 and 25 that are spaced from and parallel to each other. The point 16 is located midway between the said side surfaces of the main body.

The operation and the advantages of the present invention will now be readily understood in view of the above discussion. In order to start the wedge into the log it is only necessary to hold the log with the left hand and to drive the wedge with the right hand into the grain in the manner of a dart. The result is the arrangement shown in FIG. 1 in which the wedge is substantially mounted on the log and is firmly held for engagement with a heavy sledge hammer. It is then only necessary to release the log and the wedge and to drive the wedge into the log with the conventional heavy sledge hammer using both hands. The normal method of doing this would be to support the log vertically on the ground or on a fixed plane surface, such as the top end of a stump. Nevertheless with the present invention it is possible to lay the log on its side and to drive the wedge horizontally into the end grain. The initial driving of the wedge with the sledge hammer causes the point 16 to slide further into the log to further lend support to the wedge for the final driving action. Further driving causes the edge 15 to engage and begin to enter the grain. When it does so, the wide angle plane surfaces 22 and 23 act to separate the grain in a very rapid manner. This opens up the grain of the log very rapidly and leads to splitting in many cases. In any case, it opens the grain large enough to permit immediate subsequent entry of the face surfaces 13 and 14 which operate to split the log in the conventional hammer. In most cases, however, the large angle formed by the surfaces 22 and 23 will be sufficient to split the log without the necessity of driving the wedge further into the log, this being particularly true in cold weather and with hard wood. This relieves the difficulty that is often experienced of driving the wedge fully into the log without completely splitting the log, thus leading to the difficult operation of removing the wedge to attempt to split the log in another manner at another portion thereof. It can be seen, therefore, that it is only necessary to have available the one large sledge hammer. It is not necessary to carry to the work area a small starting hammer which can become easily lost in the chips and leaves in the woods and, particularly, in the snow. In other words, there is one less small tool that could become lost or difficult to find. In addition, the small blade provided by the edges 22 and 23 can be sharpened rather rapidly, or at least polished with a file in the woods, an operation that is difficult to perform on the broad surfaces of the conventional wedge.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Wedge for splitting a wooden log, comprising:

(a) a main body having two plane face surfaces lying at an acute angle to one another, and terminating at a lower end of the wedge, (b) two plane blade surfaces extending from the lower ends of said face surfaces said blade surfaces lying at an acute secondary angle to one another and terminating in a transverse edge, said secondary angle being substantially greater than the angle between said face surfaces, and (c) an integral point bounded by two plane surfaces which are continuous with and lie in the respective planes of said face surfaces and extend beyond said transverse edge to assist in introducing the edge into the grain of the log.

2. Wedge as recited in claim 1, wherein the main body and the point are integrally forged of steel.

3. Wedge as recited in claim 1, wherein the point is defined by two plane side surfaces which lie at an acute angle to one another.

4. Wedge as recited in claim 1, wherein the main body is provided with two plane side surfaces that are spaced from and parallel to one another, and wherein the point is located midway between the said surfaces of the main body.

5. Wedge for splitting a wooden log, comprising:

(a) a main body having two plane face surfaces lying at an acute angle to one another, and terminating at a lower end of the wedge, (b) two plane blade surfaces extending from the lower ends of said face surfaces, said blade surfaces lying at an acute secondary angle to one another and terminating in a transverse edge, said secondary angle being substantially greater than the angle between said face surfaces, and (c) an integral point bounded by two plane face surfaces which lie in the same general respective planes as said blade surfaces and as the said face surfaces of the main body, and which lie at an acute angle to one another which is less than said secondary angle, said point extending beyond said transverse edge to assist in introducing the edge into the grain of the log.

6. Wedge as recited in claim 5, wherein the main body and the point are integrally forged of steel.

7. Wedge as recited in claim 5, wherein the point is defined by two plane side surfaces which lie at an acute angle to one another.

8. Wedge as recited in claim 5, wherein the main body is provided with two plane side surfaces that are spaced from and parallel to one another, and wherein the point is located midway between the said surfaces of the main body.

9. Wedge as recited in claim 5, wherein each plane face surface of the point is triangular.

10. Wedge as recited in claim 9, wherein the point is bounded by two triangular side surfaces so that the point has the general shape of a four sided pyramid.

* * * * *